US010577814B2

(12) United States Patent
Uribeetxebarria Zubia et al.

(10) Patent No.: US 10,577,814 B2
(45) Date of Patent: Mar. 3, 2020

(54) HORIZONTAL FORMWORK SYSTEM AND SAFETY METHOD FOR INSTALLING FORMWORK PANELS IN A HORIZONTAL FORMWORK SYSTEM

(71) Applicant: Ulma C Y E, S. Coop., Oñati (ES)

(72) Inventors: Heriberto Uribeetxebarria Zubia, Arrasate (ES); Arantzazu Arabaolaza Ochoa, Oñati (ES); Yildiray Eroglu, Wiesbaden (DE)

(73) Assignee: ULMA C Y E, S. COOP., Oñati (ES)

( * ) Notice: Subject to any disclaimer, the term of this patent is extended or adjusted under 35 U.S.C. 154(b) by 0 days.

(21) Appl. No.: 16/158,799

(22) Filed: Oct. 12, 2018

(65) Prior Publication Data

US 2019/0063086 A1 Feb. 28, 2019

Related U.S. Application Data

(63) Continuation of application No. PCT/EP2017/058340, filed on Apr. 7, 2017.

(30) Foreign Application Priority Data

Apr. 12, 2016 (EP) ..... 16382164

(51) Int. Cl.
*E04H 1/00* (2006.01)
*E04G 11/38* (2006.01)
(Continued)

(52) U.S. Cl.
CPC ..... *E04G 11/38* (2013.01); *E04G 11/52* (2013.01); *E04G 11/54* (2013.01); *E04G 21/3266* (2013.01)

(58) Field of Classification Search
None
See application file for complete search history.

(56) References Cited

U.S. PATENT DOCUMENTS 4,068,446 A * 1/1978 Brueske ..... E04D 15/00 182/45
4,646,877 A * 3/1987 Whan ..... E04G 5/045 182/38
(Continued)

FOREIGN PATENT DOCUMENTS

EP 2995750 A1 3/2016
ES 2229867 A1 4/2005
(Continued)

OTHER PUBLICATIONS

International Search Report and Written Opinion in corresponding International Application No. PCT/EP2017/058340, dated May 8, 2017.

*Primary Examiner* — Basil S Katcheves
(74) *Attorney, Agent, or Firm* — Edell, Shapiro & Finnan, LLC

(57) ABSTRACT

According to one embodiment a horizontal formwork system is provided that includes a pair of parallel longitudinal beams on which a safety means is coupled for protecting against falling. The safety means includes a safety structure that is located below the formwork panels. The safety structure at least partially covers a gap existing immediately after a last assembled formwork panel and displacement means for moving the safety structure in a longitudinal direction along a length of the longitudinal beams. The displacement means is configured to be operated on by an operator allow to move the safety structure to cover the gap immediately after the last assembled formwork panel. A safety method for installing formwork panels is also provide that may include the steps of assembling at least one guide to the corresponding longitudinal beam and coupling a safety structure having at least one guided element to the
(Continued)

longitudinal beams through a guide, and sliding the safety structure along the guide to cover the gap.

20 Claims, 11 Drawing Sheets

(51) Int. Cl.
*E04G 21/32* (2006.01)
*E04G 11/52* (2006.01)
*E04G 11/54* (2006.01)

(56) References Cited

U.S. PATENT DOCUMENTS 4,986,389 A * 1/1991 Halligan, Sr. ..... E04G 21/28 182/138
6,161,648 A * 12/2000 Rexroad ..... A62B 1/22 182/138
9,038,777 B2 * 5/2015 Stearns ..... A62B 1/22 182/138
2005/0144886 A1 * 7/2005 Holawe ..... E04G 11/38 52/633
2005/0167198 A1 * 8/2005 Pelletier ..... E04G 3/26 182/138
2007/0094962 A1 * 5/2007 Schwoerer ..... B66C 1/105 52/263
2009/0090060 A1 * 4/2009 Borra ..... E04G 21/3204 49/9
2009/0212195 A1 * 8/2009 Arocena Bergareche ..... E04G 11/38 249/13
2019/0085571 A1 * 3/2019 Schneider ..... E04G 9/04

FOREIGN PATENT DOCUMENTS

FR 2944821 A1 10/2010
WO 2007003364 A1 1/2007

* cited by examiner

HORIZONTAL FORMWORK SYSTEM AND SAFETY METHOD FOR INSTALLING FORMWORK PANELS IN A HORIZONTAL FORMWORK SYSTEM

CROSS-REFERENCE TO RELATED APPLICATIONS

This application related to and claims the benefit and priority to International Application No. PCT/EP2017/058340 filed Apr. 7, 2017, which claims the benefit and priority to European Application No. EP16382164.8, filed Apr. 12, 2016.

TECHNICAL FIELD

The present invention relates to horizontal formwork systems, particularly to modular horizontal formwork systems, and to a safety method for installing formwork panels in a horizontal formwork system.

BACKGROUND

Horizontal formwork systems comprising longitudinal beams, transverse beams, formwork panels that are arranged on the longitudinal and/or transverse beams and vertical supports or struts supporting the horizontal beams, transverse beams and formwork panels are known.

For example, WO2007/003364A1 discloses a modular horizontal formwork comprising a plurality of grid elements. Each grid element comprises a plurality of longitudinal beams and at least one transverse beam that can be assembled on the vertical supports. Each basic grid element further comprises two primary beams arranged parallel to one another, each end of said primary beams being supported in one of the heads, and two corner beams arranged parallel to one another and perpendicular to the primary beams, each end of said corner beams being supported in one of the heads. The primary beams comprise supports for panels on which formwork panels are arranged.

FR2944821A1 discloses a formwork system comprising primary beams and secondary beams extending between the primary beams, said secondary beams supporting the formwork panels. Before assembling the formwork panels, the operator assembles a provisional and detachable protective base in the gaps in which the formwork panels will later be arranged for fall prevention.

SUMMARY OF THE DISCLOSURE

One aspect relates to a horizontal formwork system comprising longitudinal beams arranged in a longitudinal direction, and safety means protecting operators against falling when installing formwork panels, and comprising a safety structure which is arranged parallel to the formwork panels. The safety structure is arranged in a plane that is below said formwork panels, at least partially covering a gap existing immediately after the last assembled formwork panel.

The safety means comprise displacement means for moving the safety structure in the longitudinal direction, which allow the operator to move said safety structure as the operator places the formwork panel and to cover at least partially the gap immediately after the last assembled formwork panel.

A horizontal formwork system with optimized safety means is thereby obtained, since it is not necessary to place a safety structure under all the formwork panels, but rather the safety structure gradually moves as the panels are put in place. Furthermore, the safety means can be actuated by the operator from up above, i.e., when the operator is on the formwork panel, and from down below, when the operator is supported on the ground.

Another aspect relates to a safety method for installing formwork panels in a horizontal formwork system that may comprise the following steps:

- assembling at least one guide to the corresponding longitudinal beam in the longitudinal direction,
- coupling a safety structure comprising at least one guided element fixed in the longitudinal direction at each end of said safety structure to the corresponding longitudinal beam through the corresponding guides, the safety structure being arranged under the last assembled formwork panel, and
- sliding the safety structure in the longitudinal direction with respect to the longitudinal beams covering the gap immediately after the last assembled formwork panel.

Both the horizontal formwork system and the safety method for the installation allow assembling said systems more quickly and more efficiently.

These and other advantages and features will become evident in view of the drawings and the detailed description.

DETAILED DESCRIPTION

Figure 1:
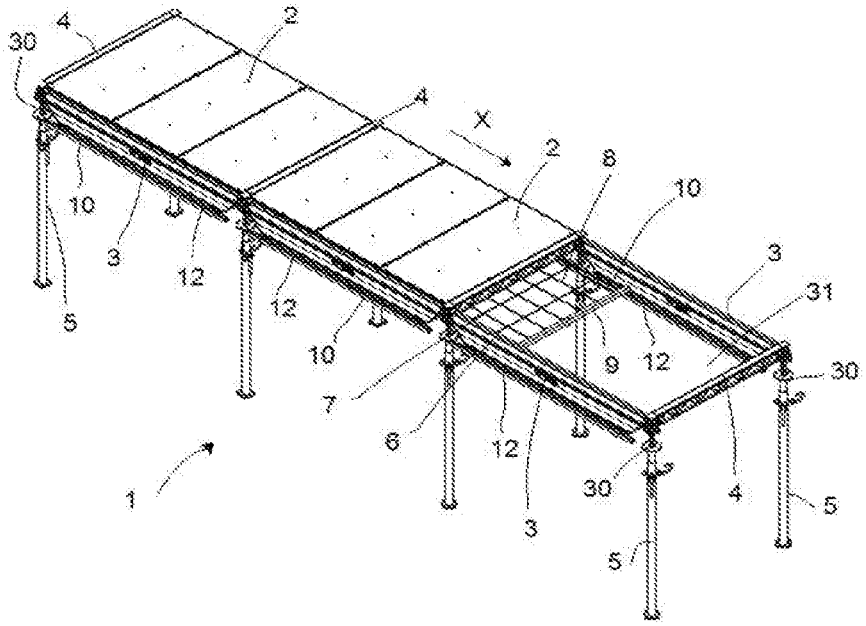
FIG. 1 shows a perspective view of an embodiment of a horizontal formwork system.
Figure 2:
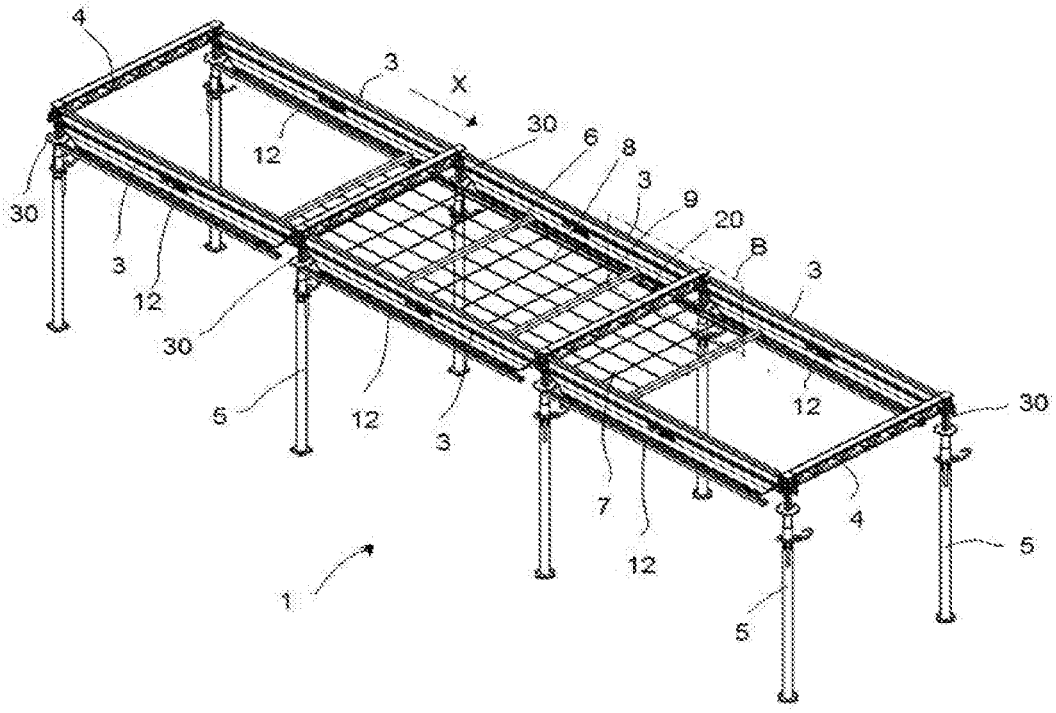
FIG. 2 shows a perspective view of the horizontal formwork system shown in FIG. 1 without the formwork panels.

FIGS. 1, 2, 13 and 14 show a horizontal formwork system 1 according to the invention, comprising longitudinal beams 3 each of which is arranged such that it is coupled to a corresponding head 30, transverse beams 4 each of which is arranged such that it is coupled to the corresponding head 30, struts 5 supporting the transverse beams 4 and the longitudinal beams 3 and each of which is arranged such that it is coupled to the corresponding head 30, and formwork panels 2 which are arranged such that they are supported on the longitudinal beams 3.

In other embodiments not shown in the figures, the horizontal formwork system comprises longitudinal beams 3 connected longitudinally to each other through first heads, transverse beams 4 connected longitudinally to each other through second heads, said transverse beams 4 being connected transversely to the corresponding longitudinal beam 3 through the corresponding second head and struts 5 attached to the corresponding longitudinal beam 3.

According to some embodiments, the horizontal formwork system 1 is a modular horizontal formwork system comprising at least two rows, each one comprising at least two beams 3 aligned longitudinally and coupled by the corresponding head 30, transverse beams 4 being arranged between the rows, the struts 5 resting on the ground.

In other embodiments not shown in the drawings, the formwork panels 2 can be arranged such that they are supported on the transverse beams 4 or on the longitudinal beams 3 and the transverse beams 4. Furthermore, in other embodiments not shown in the drawings, instead of struts 5, the horizontal formwork system 1 can comprise scaffolds, shoring or other structures supporting the formwork panels 2 and longitudinal and transverse beams.

The modular horizontal formwork system 1 comprises safety means 6 movable in a longitudinal direction preventing operators from falling off the formwork panels 2 as they are assembling said formwork panels 2.

For understanding this description, longitudinal direction will be considered the direction parallel to the longitudinal beams 3, corresponding with the direction in which the operator assembles the formwork panels 2. The direction in which said panels are assembled, hereinafter forward movement direction, is indicated with an "X" in FIGS. 1, 2, 13 and 14. There can be embodiments in which the operator firstly assembles the formwork panels 2 in a transversal direction forming a row, afterwards assembles the formwork panels 2 in a transversal direction forming a second row, and so on until the end of the longitudinal beams 3. In such a case, the direction in which the operator assembles the formwork panels 2, in particular the rows of formwork panels 2 is also longitudinal.

The safety means 6 comprise a safety structure 7 including a mesh 8 and a support 9 for said mesh 8, and displacement means 10 for moving the safety structure 7. The support 9 is preferably metallic, and the mesh 8 is preferably metallic or fabric-based. In other embodiments not shown in the drawings, the safety structure 7 can include a plurality of supports each of which supports a specific mesh, the supports being arranged such that they are attached to one another, forming the safety structure 7.

Figure 13:
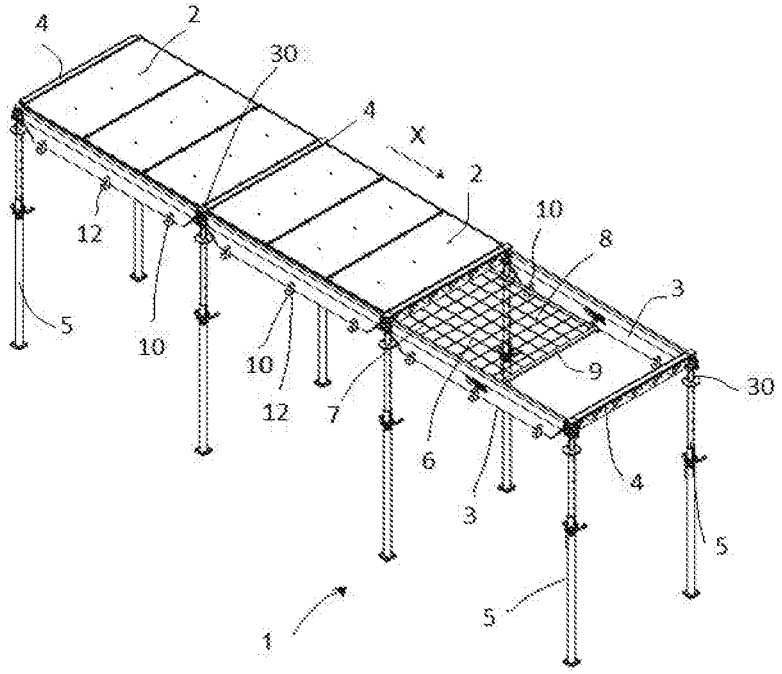
FIG. 13 shows a perspective view of another embodiment of a horizontal formwork system.
Figure 14:
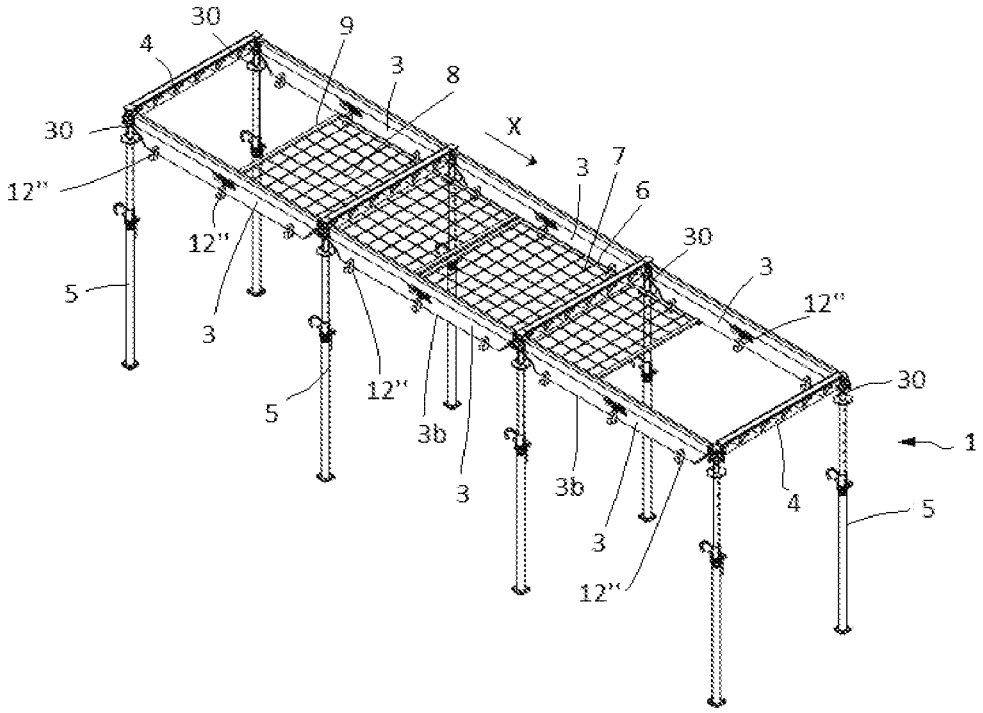
FIG. 14 shows a perspective view of the horizontal formwork system shown in FIG. 13 without the formwork panels.

Furthermore, the safety structure 7 is arranged parallel to the formwork panels 2 in a plane that is below said formwork panels 2, at least partially covering a gap 31 existing immediately after the last assembled formwork panel 2, as shown in FIGS. 1 and 13. As the operator places the formwork panels 2 on the longitudinal beams 3, moves the safety structure 7 through the displacement means 10 covering, at least partially, the gap 31 immediately after the last assembled formwork panel 2, thereby assuring protection against falling. The safety structure 7 is not a support structure that is to say, the safety structure 7 does not support neither the formworks panels 2 neither the concrete over the formworks panels. The safety structure 7 is not a work platform but rather a protection platform to prevent operators from falling. The safety structure 7 is not designed to be walk on. The function of the safety structure 7 is to support the operator in case of a fall. Operators can move the safety means 6 while they are on the formwork panels 2 or from the ground, preferably acting on the support 9 of the safety structure 7. The operator can move the safety means 6 continuously along the horizontal formwork system 1 in the longitudinal direction X without it being necessary to disassemble the safety means 6 once they arrive to the end of the corresponding longitudinal beam 3. The operator can also move the safety means 6 through a transition zone 42 of the horizontal formwork system 1, transition zone 42 being understood as the zone in which two longitudinal beams 3 are coupled to the corresponding head 30 and including a gap 43 between the two consecutively arranged longitudinal beams 3.

The displacement means 10 for moving the safety structure 7 comprises guided elements 11; 11'; 11" fixed to the safety structure 7 and guides 12; 12'; 12" coupled to the longitudinal beams 3, shown in FIGS. 3, 4, 5, 11 and 12, which collaborate with one another for moving said safety structure 7, the guide 12; 12'; 12" and the corresponding guided element 11; 11'; 11" being arranged such that they are connected to one another in a sliding manner.

The guided elements 11; 11'; 11" are arranged, respectively, such that they are fixed to the support 9 of the safety structure 7, in the longitudinal direction of the formwork system 1. According to one embodiment the support 9 includes first and second spaced apart longitudinal supports that are arranged parallel to one another. In turn, the guides 12; 12'; 12" are arranged, respectively, such that they are coupled to the longitudinal beams 3 in the longitudinal direction of the formwork system 1. Particularly, in the embodiments shown in FIGS. 1 to 16, the safety structure 7 has two guided elements 11; 11'; 11". Each of the guided elements 11; 11'; 11" is arranged such that it is fixed at the corresponding side of the safety structure 7, extending longitudinally along the safety structure 7. The safety structure 7 is coupled to both longitudinal beams 3 arranged parallel to one another, through the corresponding guide 12; 12'; 12" coupled to the respective longitudinal beam 3.

In the embodiments shows in the figures, the guides 12; 12'; 12" are attached to the corresponding longitudinal beam 3. In other embodiments not shown, said guides can be coupled to the corresponding longitudinal beam 3 through the corresponding heads, the guides being integrated in the corresponding head.

Figure 3:
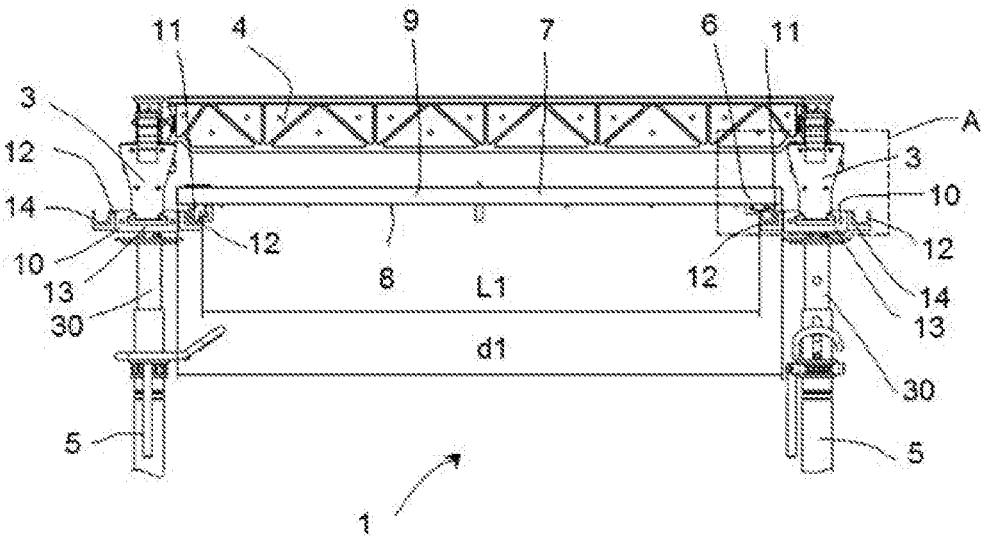
FIG. 3 shows a front view of the horizontal formwork system shown in FIG. 1 without the formwork panels in a working position.
Figure 15:
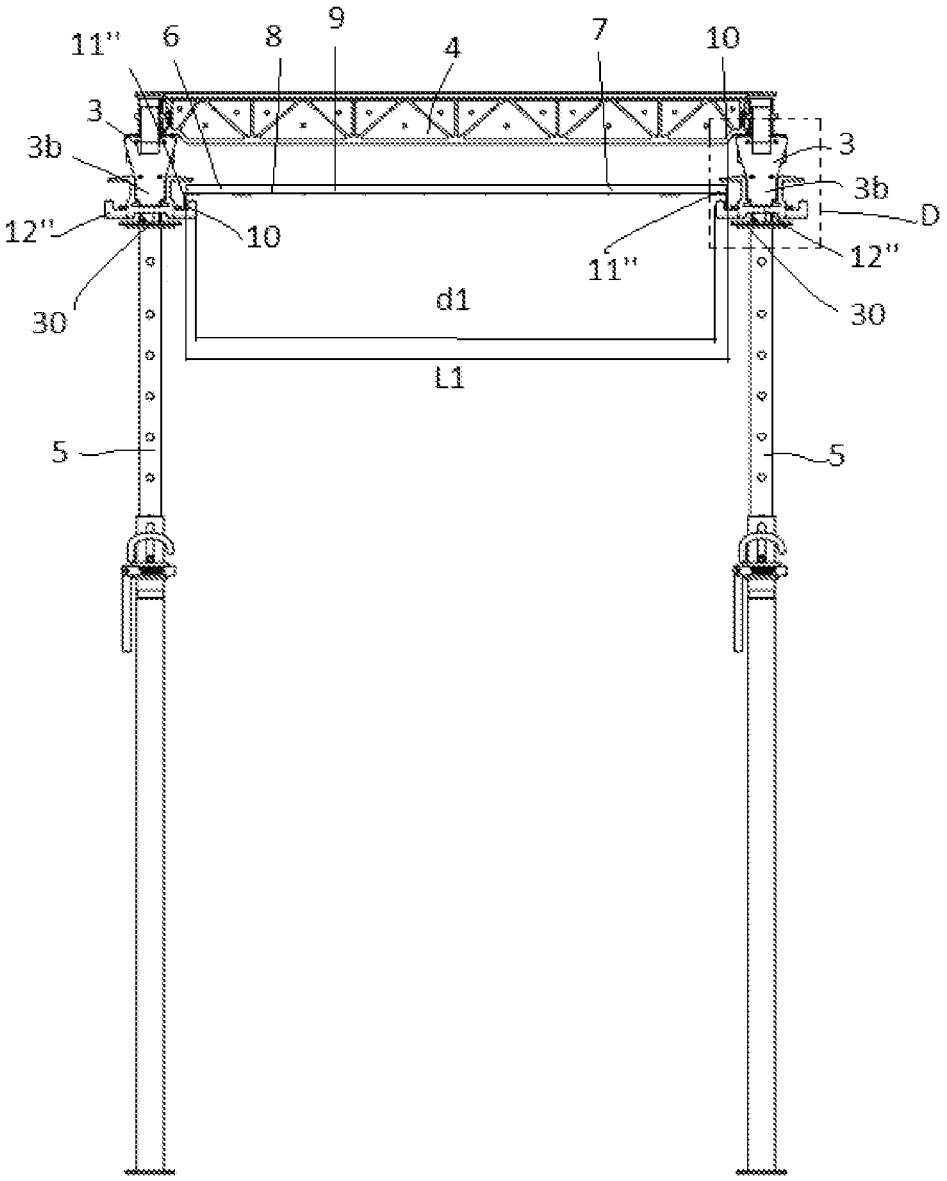
FIG. 15 shows a front view of the horizontal formwork system shown in FIG. 13 without the formwork panels in a working position.

For safety reasons, the width d1 of the safety structure 7 is larger than the distance L1 between the guides 12; 12" arranged facing one another, as shown in FIGS. 3 and 15.

Figure 4:
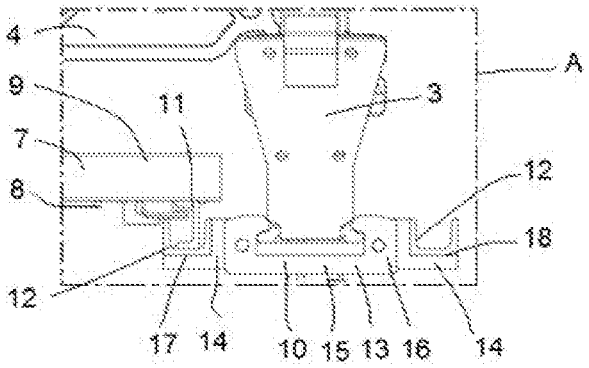
FIG. 4 shows detail A of the front view of the horizontal formwork system shown in FIG. 3.
Figure 5:
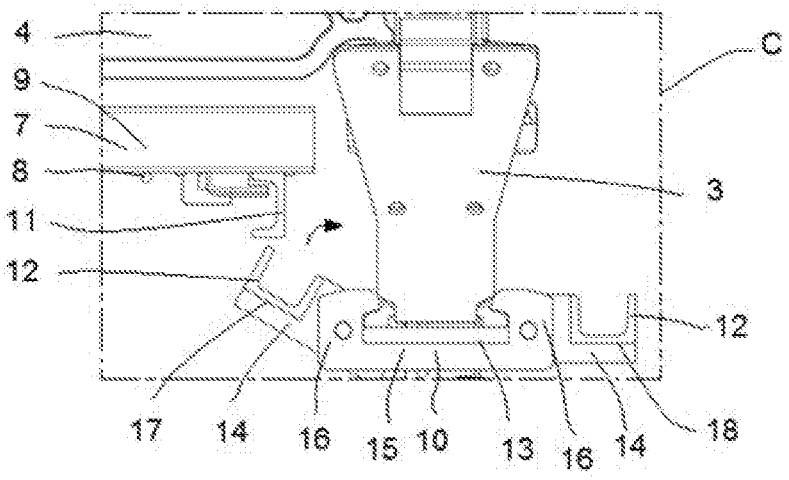
FIG. 5 shows detail C of the front view of the horizontal formwork system shown in FIG. 3 in an intermediate position between the working position shown in FIG. 3 and the assembly/disassembly position.

In the first embodiment, shown in FIGS. 1 to 10, the guided element 11 includes a profile which is arranged such that it is partially housed in a profile of the guide 12. Both profiles of the guided element 11 and of the guide 12 respectively have a C-shaped cross-section, as shown in FIGS. 3, 4 and 5, which allows each guided element 11 to slide on the corresponding guide 12 when the operator acts on the safety structure 7.

To enable assembling and disassembling the safety structure 7 in the horizontal formwork system 1 shown in FIGS. 1 to 10, the displacement means 10 comprises couplings 14 which couple each guide 12 to the corresponding longitudinal beam 3. Each coupling 14 enables the pivoting of the guide 12 upward as shown in FIG. 5. Therefore, when the operator assembles the safety structure 7 from down below, said safety structure 7 initially pushes the guides 12 upwards, forcing them to pivot as shown in FIG. 5, from the (substantially horizontal) working position shown in FIGS. 3 and 4 to the (substantially vertical) assembly/disassembly position as a result of the respective couplings 14. Once the safety structure 7 surpasses the guides 12, said guides 12 are lowered, returning to the working position, the guided elements 11 of the support structure 7 being arranged such that they are partially housed respectively in the guides 12 in said working position.

In turn, the displacement means 10 comprise supports 13 which are arranged such that they are fixed to the bottom of the corresponding longitudinal beams 3, each guide 12 being arranged such that it is pivotally coupled to the corresponding support 13 between a working position shown in FIGS. 3 and 4, and an assembly/disassembly position shown in FIG. 5. Each support 13 of the displacement means 10, shown in detail in FIGS. 3, 4 and 7, comprises a base 15 which is fixed to the bottom of the corresponding longitudinal beam 3 and extensions 16, each coupling 14 being coupled to each extension 16 preferably through bolts not depicted in the drawings. Each coupling 14 has, at one end, a support surface 18 on which the guide 12 is arranged such that it is supported thereon, and at the other end, a stop 17 abutting against the support 13 in the working position, keeping the guide 12 in a horizontal position.

In the first embodiment, shown in FIGS. 1 to 10, each support 13 of the displacement means 10 at least partially supports two guides 12 arranged parallel to one another, pivotally coupled to said support 13 through the corresponding couplings 14. In other embodiments, each support 13 supports one guide 12 instead of two guides 12.

In other embodiments not shown in the drawings, the safety structure 7, particularly the support 9 of the safety structure 7, can be a flexible or folding structure, and said safety structure 7 can even be telescopic, which would allow assembling and disassembling the safety structure without the guides 12 having to be able to pivot.

Figure 11:
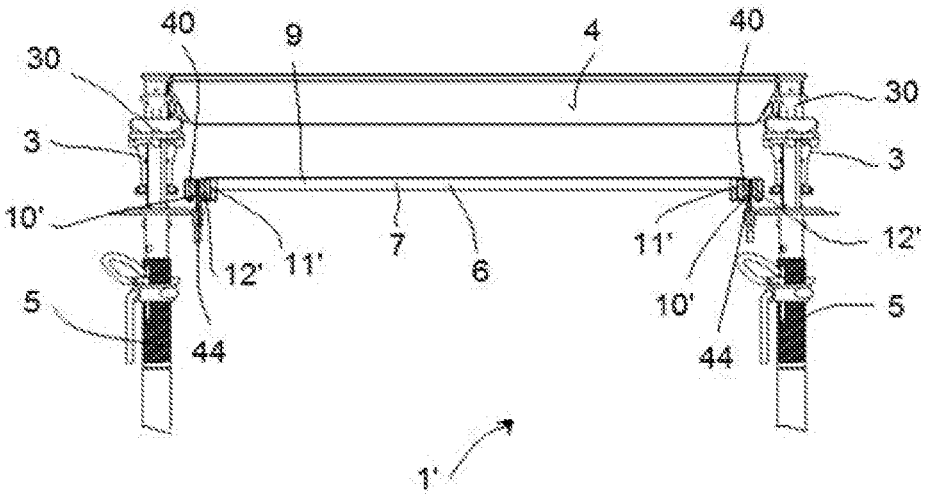
FIG. 11 shows a front view of another embodiment of a horizontal formwork system.
Figure 12:
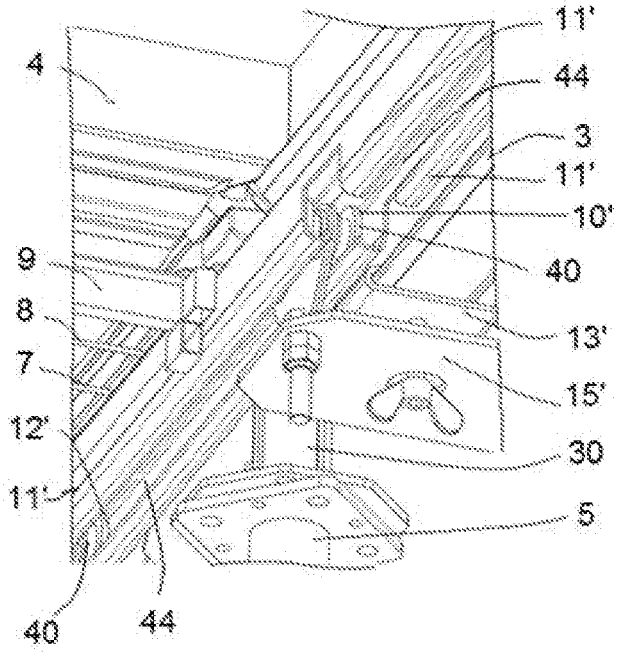
FIG. 12 shows a partial perspective view of the embodiment of the horizontal formwork system shown in FIG. 11.

In a second embodiment shown in FIGS. 11 and 12, each guide 12' is arranged such that it is fixed respectively to the bottom of the respective longitudinal beam 3, and includes at least one rolling element 40 which is arranged such that it is housed inside the respective guided element 11', particularly inside a profile of the guided element 11', the profile of the guided element 11' sliding with respect to the rolling element 40 of the guide 12' when the operator pushes the support structure 7. The profile of the guided element 11' includes a groove 44 through which the corresponding rolling elements 40 are arranged such that they are housed therein. The rolling elements 40 are arranged such that they are fixed to supports 13' fixed to the respective longitudinal beams 3, particularly they are arranged such that they are fixed to respective bases 15' of the supports 13'.

Figure 16:
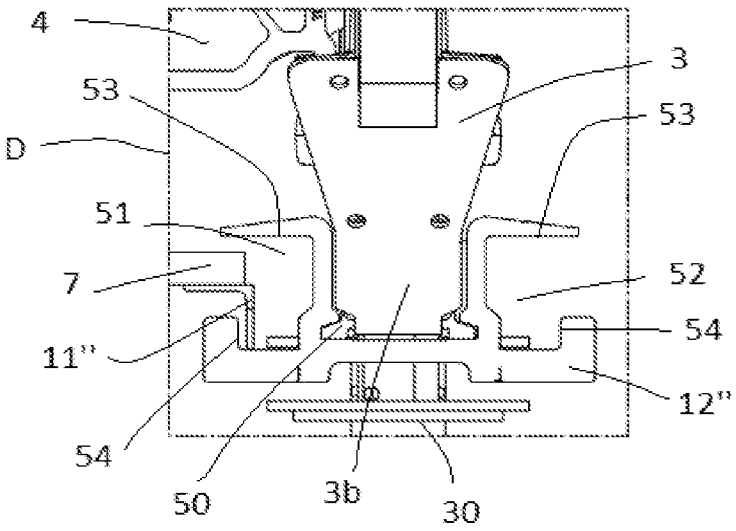
FIG. 16 shows detail D of the front view of the horizontal formwork system shown in FIG. 15.

In the third embodiment, shown in FIGS. 13 to 17, the guided element 11" includes a profile which is arranged such that it is partially housed in a profile of the guide 12". The profile of the guided element 11" has a L-shaped cross-section as shown in FIGS. 15 and 16 and it is attached in each side of the support structure 7, extending longitudinally along the support structure 7. The displacement means 10 comprise a plurality of guides 12" each coupled to the bottom **3*b* of each longitudinal beam 3, the guides 12" being discrete elements arranged along the corresponding longitudinal beam 3. Each guide 12" comprises a first cavity 50 in which the longitudinal beam 3 is partially housed, the geometry of the longitudinal beam 3 being complementary to the first cavity 50 so that the guide 12" is kept coupled to the longitudinal beam 3 and a second cavity 51 in which the corresponding guided element 11" is partially housed, said guided element 11" resting on the corresponding guide 12". Furthermore, each guide 12" comprises a third cavity 52 symmetrically to the second cavity 51 wherein the guided element 11" of another support structure 7** can be housed.

The second cavity 51 and the third cavity 52 are open cavities. The second cavity 51 is delimitated by a first surface 53 substantially horizontal, limiting the upwards vertical displacement of the safety structure 7 once the guided element 11" is housed in said cavity 51, and by a second surface 54 substantially vertical, limiting the horizontal displacement of the safety structure 7. Analogously, the third cavity 52 is delimitated by the corresponding first surface 53 and second surface 54.

In turn, the horizontal formwork system 1 comprises blocking means 20; 20' for blocking the displacement means 10; 10' for moving the safety structure 7 in the longitudinal direction, said blocking means 20; 20'. Said blocking means 20; 20' furthermore allow the movement of the safety structure 7 in the direction opposite the forward movement direction X.

In the first embodiment shown in FIGS. 1 to 10, the blocking means 20 acts by blocking the movement of the safety structure 7 when it is no longer in contact with the respective guides 12. The blocking means 20 is arranged such that it is pivotally coupled to the guided elements 11.

The blocking means 20 comprise a first part 21 and a second part 22, both parts 21 and 22 being coupled to the safety structure 7 and pivotally coupled to one another. When the blocking means 20 is not acting (non-blocking position shown in FIGS. 6 and 7), both the first part 21 and the second part 22 are supported on the corresponding guide 12. In contrast, when the safety structure 7 passes through the transition zone 42 of the horizontal formwork system 1, the first part 21 and the second part 22 pivot to a blocking position shown in FIG. 8 in which the second part 22 abuts against the guide 12 arranged after the gap 43 in the forward movement direction X.

Figure 6:
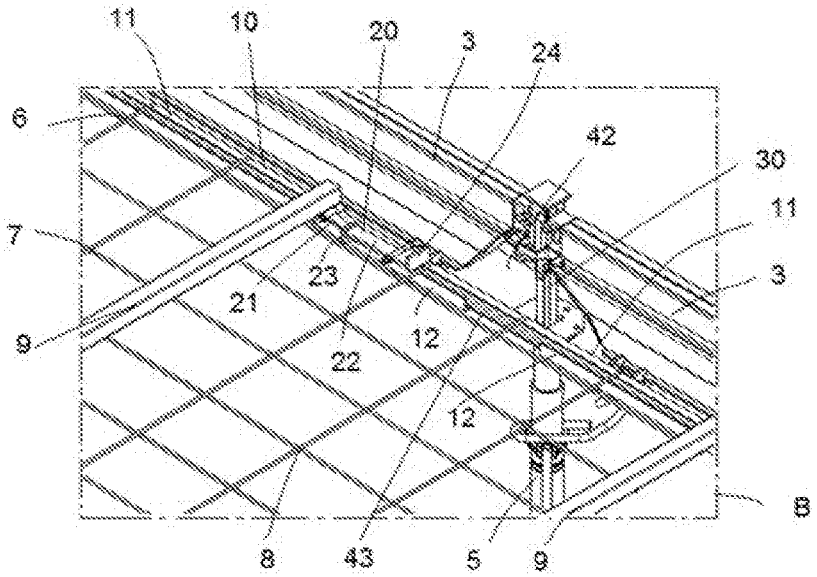
FIG. 6 shows detail B of the horizontal formwork system shown in FIG. 1 wherein blocking means are shown in a non-blocking position.
Figure 7:
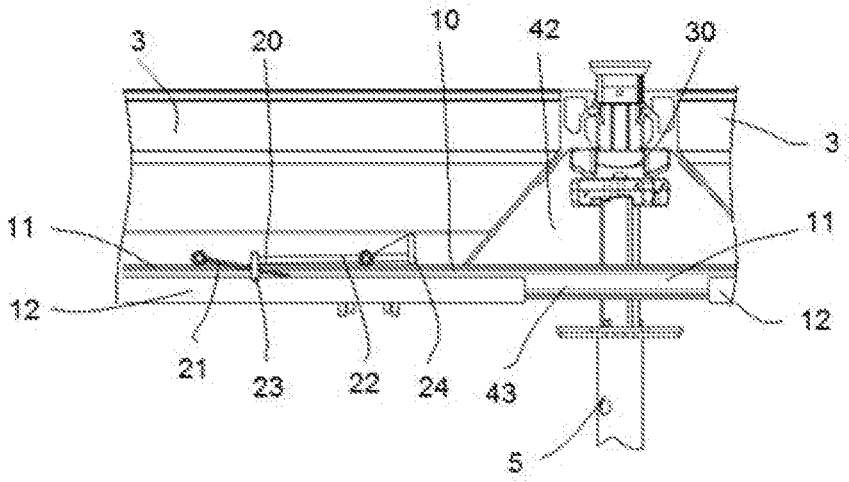
FIG. 7 shows a side view of the blocking means shown in FIG. 6 in the non-blocking position.
Figure 8:
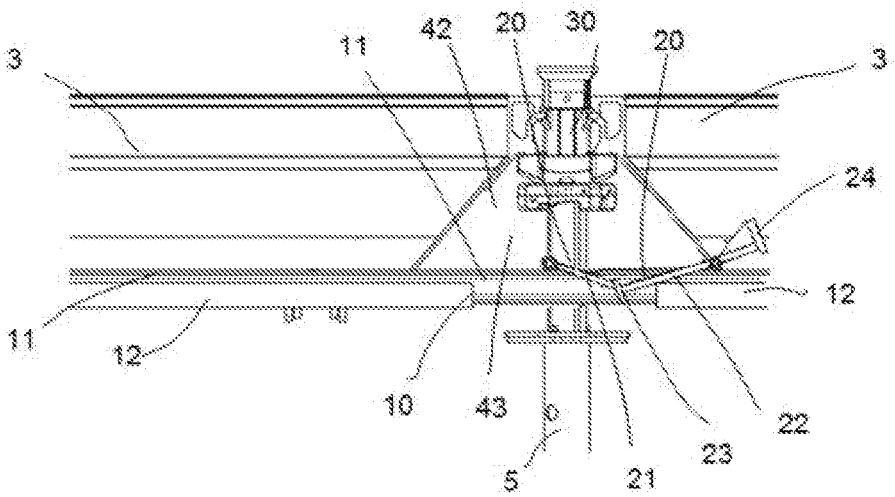
FIG. 8 shows a side view of the blocking means shown in FIG. 6 in a blocking position.
Figure 9:
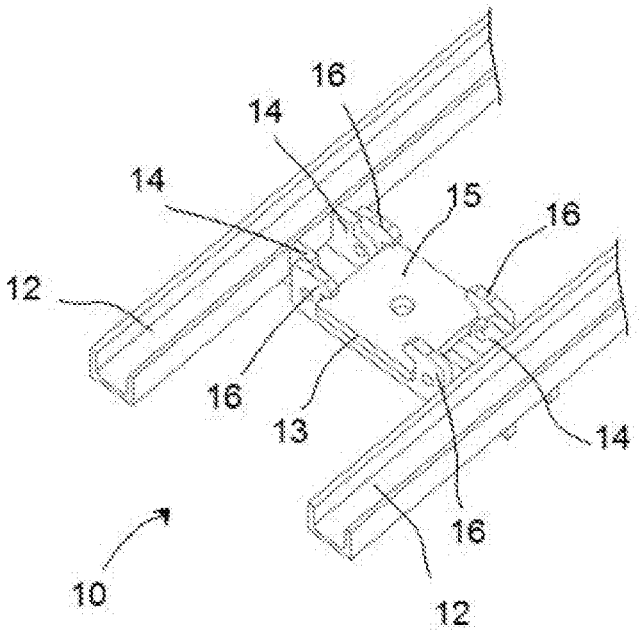
FIG. 9 shows a partial view of displacement means comprised in the horizontal formwork system shown in FIG. 1.
Figure 10:
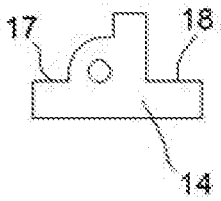
FIG. 10 shows a front view of an element of the displacement means shown in FIG. 9.

As shown in FIGS. 6 to 8, in this embodiment the first part 21 and the second part 22 pivot in opposite directions. The first part 21 goes through a plate 23 comprised in the second part 22, said plate 23 being arranged such that it is supported on the corresponding guide 12 in the non-blocking position shown in FIGS. 6 and 7. The second part 22 further comprises at the end opposite the plate 23 a stop 24 which, when actuated by the operator, pivots the second part 22, forcing the first part 21 to pivot until both the first part 21 and the second part 22 release the following guide 12 arranged in the forward movement direction X and the safety structure 7 can once again move along the next guide 12, the first part 21 and the second part 22 sliding along the corresponding guide 12.

Figure 17:
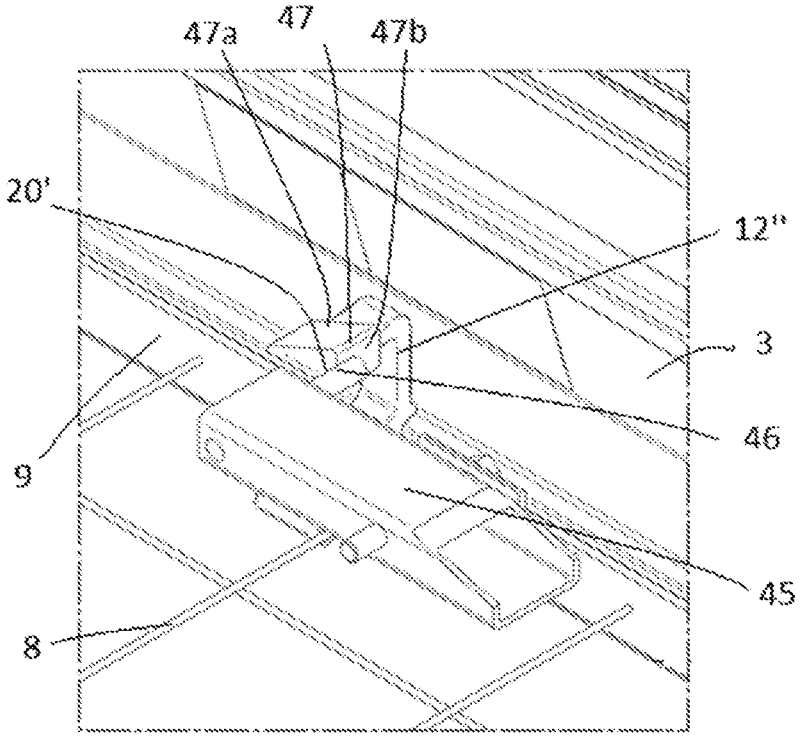
FIG. 17 shows detail of the horizontal formwork system shown in FIG. 13 wherein blocking means are shown in a blocking position.

In the third embodiment, the blocking means 20', shown in FIG. 17, acts also by blocking the movement of the safety structure 7 in the longitudinal direction. The blocking means 20' include at least a support 45 attached to the safety structure 7, in particular to the support 9 of the safety structure 7, and a stop 47 included in at least one guide 12". The support 45 includes a projection 46 extending in a transversal direction, the projection 46 abutting against the stop 47 in the blocking position. The stop 47 has a wedge shape with a limiting surface 47*b* substantially vertical against which the projection 46 abuts and an inclined surface 47*a* continuous to the limiting surface 47*b* along which the projection 46 slides to the non-blocked position once the operator rises the safety structure 7 till the projection 46 does not abut against the limiting surface 47*b*.

Another aspect relates to a safety method for installing formwork panels in the horizontal formwork system 1 may comprise the following steps:

assembling at least one guide 12; 12'; 12" to a corresponding longitudinal beam 3 in the longitudinal direction, coupling a safety structure 7 comprising at least one guided element 11; 11'; 11' fixed in the longitudinal direction at each end of said safety structure 7 to the corresponding longitudinal beams 3 through the corresponding guides 12; 12'; 12", the safety structure 7 being arranged parallel to the formwork panels 2 in a plane that is below said formwork panels 2, and sliding the safety structure 7 in the longitudinal direction with respect to the longitudinal beams 3 covering a gap 31 immediately after the last assembled formwork panel 2.

At least part of the safety structure 7 is arranged under the last assembled formwork panel 2 when it covers the gap 31 immediately after the last assembled formwork panel 2, i.e., part of the safety structure 7 overlaps with at least the last installed formwork panel.

The operator moves the safety structure 7 in the longitudinal direction along the rows comprising at least two beams 3 aligned longitudinally and coupled by the corresponding head 30 without disassembling the safety structure 7 from the corresponding beams 3.

The operator moves the safety structure 7 in the longitudinal direction to the blocking position, in which blocking means 20; 20' block the longitudinal displacement of said safety structure 7. In the first embodiment, when the safety structure 7 is in the block position, the blocking means is arranged such that it is coupled to at least one corresponding guided element 11 of the safety structure 7, the blocking means 20 being partially housed in the gap 43 and abutting against the guide 12, blocking the movement of the safety structure 7. In the third embodiment, when the projection 46 of the safety structure 7 abuts against the stop 47 of the corresponding guide 12", the safety structure 7 stops, its longitudinal displacement being blocked. In such a case, in order to unblock it, the operator must elevate the safety structure 7 till the projection 46 overcomes the stop 47 of the guide 12".

In addition, in the first embodiment, in order to assemble the safety structure 7 on the respective longitudinal beams 3, the safety structure 7 pushes the guides 12 upwards, making them pivot upwards with respect to the corresponding longitudinal beams 3, as shown in FIG. 5, until being positioned in the assembly/disassembly position, the guides 12 returning to the working position once the safety structure 7 vertically surpasses the guides 12 and the guided elements 11 are in contact with the respective guides 12, particularly at least partially housed in said guides 12.

In the event that it is necessary to disassemble the safety structure 7, for example to release a column, the operator must move the safety structure 7 upwards from one of its ends by releasing the guided element 11 arranged at said end of the safety structure 7 from the corresponding guide 12, until it vertically surpasses said corresponding guide 12. In parallel, the guided element 11 arranged at the other end of the safety structure 7 remains housed in the corresponding guide 12. Then the operator must push the guide 12 upwards to the assembly/disassembly position in which the operator may lower the safety structure 7, pivoting it with respect to the guided element 11 which remains housed in the guide 12.

In the second embodiment the safety structure 7 is coupled longitudinally to the corresponding longitudinal beams 3, housing the respective guides 12 inside the respective guided elements 11' fixed to the safety structure 7.

Finally, in the third embodiment, to enable assembling and disassembling the safety structure 7 in the horizontal formwork system 1 shown in FIGS. 13 to 17, the safety structure 7 should be rotated in order to introduce or take out the guided element 11" of the safety structure 7 from the cavity 51 and 52 of the corresponding guide 12", avoiding the first surface 53 and second surface 54 of the cavity 51 and 52. The safety structure 7 can also be assembled and disassembled by displacing it along the guides 12" until the guide elements 11" are liberated from the corresponding guides 12".

The following clauses disclose in an unlimited way embodiments of horizontal formwork systems and methods of assembling the same.

Clause 1: A horizontal formwork system comprising longitudinal beams (3) arranged in a longitudinal direction, and safety means (6) protecting operators against falling when installing formwork panels (2), said safety means (6) comprising a safety structure (7) which is arranged parallel to the formwork panels (2), characterized in that the safety structure (7) is arranged in a plane that is below said formwork panels (2), at least partially covering a gap (31) existing immediately after the last assembled formwork panel (2), and in that the safety means (6) comprise displacement means (10) for moving the safety structure (7) in the longitudinal direction (X), which allow the operator to move said safety structure (7) as the operator places the formwork panels (2) and to cover at least partially the gap (31) immediately after the last assembled formwork panel (2).

Clause 2: The horizontal formwork system according to clause 1, wherein the displacement means (10) comprise at least one guide (12; 12'; 12") coupled to the corresponding longitudinal beam (3) in the longitudinal direction, and at least one guided element (11; 11'; 11") fixed to the safety structure (7) in the longitudinal direction, the guide (12; 12'; 12") and the guided element (11; 11'; 11") being arranged such that they are connected in a sliding manner.

Clause 3: The horizontal formwork system according to clause 2, comprising at least two rows arranged parallel, each row comprising at least two beams (3) coupled longitudinally by a corresponding head (30), the corresponding guide (12; 12'; 12") of each longitudinal beam (3) being arranged such that it is coupled to each longitudinal beam (3) and the safety structure (7) includes two guided elements (11; 11'; 11"), each of which is arranged such that it is fixed at one end of the safety structure (7), both guided elements (11; 11'; 11") being arranged parallel to one another, the safety structure (7) being displaceable along the rows.

Clause 4: The horizontal formwork system according to clause 3, wherein the width (d1) of the safety structure (7) is larger than the distance (L1) between the two guides (12; 12") arranged facing one another.

Clause 5: The horizontal formwork system according to any of clauses 2 to 4, wherein the guide (12; 12") includes a profile in which a profile of the respective guided element (11; 11") is arranged such that it is partially housed therein, the profile of the guided element (11; 11") sliding along the profile of the guide (12; 12") when the operator pushes the support structure (7).

Clause 6: The horizontal formwork system according to any of clauses 2 to 4, wherein the guide (12') includes at least one rolling element which is arranged such that it is housed in a profile of the respective guided element (11'), the profile of the guided element (11') sliding with respect to the rolling element of the guide (12') when the operator pushes the support structure (7).

Clause 7: The horizontal formwork system according to any of clauses 2 to 5, wherein the displacement means (10) comprise at least one support (13) which is arranged such that it is fixed to the corresponding longitudinal beam (3), the respective guide (12) being arranged such that it is pivotally coupled to the corresponding support (13) between a working position and an assembly/disassembly position.

Clause 8: The horizontal formwork system according to clause 7, wherein the displacement means (10) comprise at least one coupling (14) coupled to the support (13) and comprising, at one end, a support surface (18) on which the guide (12) is arranged such that it is supported thereon and, at the other end, a stop (17) abutting against the support (13) in the working position, keeping the guide (12) in a horizontal position.

Clause 9: The horizontal formwork system according to any of clauses 2 to 5, wherein the displacement means (10) comprise a plurality of guides (12") each coupled to a bottom (3*b*) of each longitudinal beam (3), the guides (12") being discrete elements arranged along the corresponding longitudinal beam (3).

Clause 10: The horizontal formwork system according to clause 9, wherein each guide (12") comprises a first cavity (50) in which the longitudinal beam (3) is partially housed, the guide (12") being coupled to the longitudinal beam (3), and a second cavity (51) in which the corresponding guided element (11") is partially housed, said guided element (11") resting on the corresponding guide (12"), the second cavity (51) being delimitated by a first surface (53) substantially horizontal, limiting the upwards vertical displacement of the safety structure (7), and by a second surface (54) substantially vertical, limiting the horizontal displacement of the safety structure (7).

Clause 11: The horizontal formwork system according to any of clauses 2 to 8, comprising blocking means (20) for blocking the safety structure (7), arranged such that they are coupled to the guided element (11), blocking the movement of the safety structure (7) when said blocking means (20) go through a transition zone (42) of the horizontal formwork system (1), said transition zone (42) being a zone including a gap (43) between two consecutively arranged longitudinal beams (3), the blocking means (20) being arranged such that they are at least partially housed in said gap (43), abutting against the corresponding guide (12) arranged after the gap (43).

Clause 12: The horizontal formwork system according to clause 11, wherein the blocking means (20) include at least one part (21) pivotally coupled to the safety structure (7), pivoting from a working position in which it is in contact with the corresponding guide (12), to a blocking position in which the part (21) abuts against the guide (12) arranged after the gap (43), preventing the forward movement of the safety structure (7).

Clause 13: The horizontal formwork system according to clause 12, wherein the part (21) includes a releasing element (24) which, when actuated by the operator, forces the part (21) to pivot until it no longer abuts against the guide (12) arranged after the gap (43) and allows the forward movement of the safety structure (7).

Clause 14: The horizontal formwork system according to any of clauses 9 to 11, comprising blocking means (20') for blocking the safety structure (7) which include at least a support (45) attached to the safety structure (6) and a stop (47) included in at least one guide (12"), the support (45) including a projection (46) in a transversal direction configured to abut against the stop (47) blocking the displacement of the safety structure (7) in the longitudinal direction (X) in the blocking position.

Clause 15: A safety method for installing formwork panels (2) in a horizontal formwork system (1) according to any of the claims 1 to 14, characterized in that it comprises the following steps:

assembling at least one guide (12; 12'; 12") to the corresponding longitudinal beam (3) in the longitudinal direction, coupling the safety structure (7) comprising a guided element (11; 11'; 11") fixed longitudinally at each end of said safety structure (7) to the corresponding longitudinal beam (3) through the corresponding guides (12; 12'; 12"), the safety structure (7) being arranged under the last assembled formwork panel (2), and sliding the safety structure (7) in the longitudinal direction with respect to the longitudinal beams (3) covering the gap (31) immediately after the last assembled formwork panel (2), Clause 16: The safety method according to clause 15, wherein the safety structure (7) is movable continuously in the longitudinal direction (X) along at least two longitudinal beams (3) coupled to each other, without disassembling the safety structure (7).

Clause 17: The safety method according to clauses 15 or 16, wherein for connecting the safety structure (7) to the corresponding longitudinal beam (3), when the operator assembles the safety structure (7) from down below, said safety structure (7) pushes the guides (12) upwards, making them pivot in the longitudinal direction with respect to the corresponding longitudinal beam (3) through couplings (14) which couple each guide (12) to the corresponding longitudinal beam (3), until being positioned in an assembly/disassembly position, the guides (12) returning to a working position once the safety structure (7) vertically surpasses the guides (12) and the guided elements (11) are arranged such that they are partially housed respectively in the respective guides (12).

Clause 18: The safety method according to any of clauses 15 to 17, wherein the operator moves the safety structure (7) in the longitudinal direction to a blocking position, in which blocking means (20), arranged such that they are coupled to at least one corresponding guided element (11) of the safety structure (7), reach a transition zone (42) of the horizontal formwork system (1) including a gap (43) between the consecutively arranged guides (12), the blocking means (20) being partially housed in the gap (43) and abutting against the guide (12), blocking the movement of the safety structure (7).

Clause 20: The safety method according to any of clauses 15 to 17, wherein the operator moves the safety structure (7) in the longitudinal direction (X) until a blocking position, in which the safety structure (7) is blocked by abutting against a stop (47) included in at least one guide (12) arranged in each longitudinal beam (3).

What is claimed is:

1. A horizontal formwork system comprising:

a first module that includes first and second longitudinal beams that are arranged spaced-apart and parallel to one another, the first module further including first and second formwork panels that are each supported on the first and second longitudinal beams, the second form work panel being located forward of the first formwork panel;

a second module that includes a third longitudinal beam parallel to and located forward of the first longitudinal beam and a fourth longitudinal beam parallel to and located forward of the second longitudinal beam;

a first head that supports a forward end of the first longitudinal beam and a rear end of the third longitudinal beam;

a second head that supports a forward end of the second longitudinal beam and a rear end of the fourth longitudinal beam;

a safety structure that is arranged below the second formwork panel and at least partially covers a gap existing forward of the second formwork panel, the safety structure including a protection platform that is attached to first and second longitudinal supports that are arranged spaced-apart and parallel to one another, the first and second longitudinal supports being arranged parallel to the first and second longitudinal beams, the protection platform being configured to capture an operator of the horizontal formwork system in the event the operator falls during an installation of the second formwork panel;

a displacement assembly that facilitates a movement of the safety structure in a forward movement direction, the displacement assembly configured to be operated on by the operator to move the safety structure in the forward movement direction across the first and second heads without the need to disassemble the safety structure.

2. The horizontal formwork system according to claim 1, wherein the displacement assembly comprises first, second, third and fourth guide supports that are respectively coupled to the first, second, third and fourth longitudinal beams, and first and second guide elements that are respectively coupled to the first and second longitudinal supports of the safety structure, the first guide element configured to slide on the first and third guide supports, the second guide element configured to slide on the second and fourth guide supports.

3. The horizontal formwork system according to claim 2, wherein first, second, third and fourth guide supports and the first and second guide elements each comprises a C-shaped cross-section.

4. The horizontal formwork system according to claim 2, wherein the first and second guide elements each comprises an L-shaped cross-section.

5. The horizontal formwork system according to claim 2, wherein the first and third guide supports are respectively coupled to the first and third longitudinal beams through the first head and the second and fourth guide supports are respectively coupled to the second and fourth longitudinal beams through the second head.

6. The horizontal formwork system according to claim 2, wherein a width of the safety structure transverse to the forward movement direction is larger than a distance between the first and second guide supports and a distance between the third and fourth guide supports.

7. The horizontal formwork system according to claim 2, further comprising a stop surface located in the second guide element, there being a transverse projection attached to or forming a part of the first longitudinal support of the safety structure, the transverse projection being configured to abut the stop surface to block advancement of the safety structure in the forward movement direction.

8. The horizontal formwork system according to claim 1, wherein the displacement assembly comprises a first plurality, a second plurality, third plurality and fourth plurality of spaced-apart guide supports that are respectively coupled to the first, second, third and fourth longitudinal beams, the displacement assembly further including first and second guide elements that are coupled to the first and second longitudinal supports of the safety structure, the first guide element configured to slide on the first and third plurality of spaced-apart guide supports, the second guide element configured to slide on the second and fourth plurality of spaced-apart guide supports.

9. A horizontal formwork system comprising:

a first module that includes first and second longitudinal beams that are arranged spaced-apart and parallel to one another, the first module further including first and second formwork panels that are each supported on the first and second longitudinal beams, the second form work panel being located forward of the first formwork panel;

a second module that includes a third longitudinal beam parallel to and located forward of the first longitudinal beam and a fourth longitudinal beam parallel to and located forward of the second longitudinal beam;

a first head that supports a forward end of the first longitudinal beam and a rear end of the third longitudinal beam;

a second head that supports a forward end of the second longitudinal beam and a rear end of the fourth longitudinal beam;

a safety structure that is arranged below the second formwork panel and at least partially covers a gap existing forward of the second formwork panel, the safety structure including a protection platform that is attached to first and second longitudinal supports that are arranged spaced-apart and parallel to one another, the first and second longitudinal supports being arranged parallel to the first and second longitudinal beams, the protection platform being configured to capture an operator of the horizontal formwork system in the event the operator falls during an installation of the second formwork panel;

a displacement assembly that facilitates a movement of the safety structure in a forward movement direction, the displacement assembly configured to be operated on by the operator to move the safety structure in the forward movement direction across the first and second heads without the need to disassemble the safety structure, wherein the displacement assembly comprises first, second, third and fourth guide supports that are respectively coupled to the first, second, third and fourth longitudinal beams, and first and second guide elements that are respectively coupled to the first and second longitudinal supports of the safety structure, the first guide element configured to slide on the first and third guide supports, the second guide element configured to slide on the second and fourth guide supports, wherein each of the first and third guide supports includes a housing in which a part of the first guide element is configured to reside, and each of the second and fourth guide supports includes a housing in which a part of the second guide element is configured to reside.

10. The horizontal formwork system according to claim 9, wherein the part of the first guide element includes at least one rolling element and the part of the second guide element includes at least one rolling element.

11. A horizontal formwork system comprising:

a first module that includes first and second longitudinal beams that are arranged spaced-apart and parallel to one another, the first module further including first and second formwork panels that are each supported on the first and second longitudinal beams, the second form work panel being located forward of the first formwork panel;

a second module that includes a third longitudinal beam parallel to and located forward of the first longitudinal beam and a fourth longitudinal beam parallel to and located forward of the second longitudinal beam;

a first head that supports a forward end of the first longitudinal beam and a rear end of the third longitudinal beam;

a second head that supports a forward end of the second longitudinal beam and a rear end of the fourth longitudinal beam;

a safety structure that is arranged below the second formwork panel and at least partially covers a gap existing forward of the second formwork panel, the safety structure including a protection platform that is attached to first and second longitudinal supports that are arranged spaced-apart and parallel to one another, the first and second longitudinal supports being arranged parallel to the first and second longitudinal beams, the protection platform being configured to capture an operator of the horizontal formwork system in the event the operator falls during an installation of the second formwork panel;

a displacement assembly that facilitates a movement of the safety structure in a forward movement direction, the displacement assembly configured to be operated on by the operator to move the safety structure in the forward movement direction across the first and second heads without the need to disassemble the safety structure, wherein the displacement assembly comprises first, second, third and fourth guide supports that are respectively coupled to the first, second, third and fourth longitudinal beams, and first and second guide elements that are respectively coupled to the first and second longitudinal supports of the safety structure, the first guide element configured to slide on the first and third guide supports, the second guide element configured to slide on the second and fourth guide supports, wherein the displacement assembly includes a first support fixed to the first longitudinal beam, the first guide support being coupled to the fixed support so that the first guide support is capable of pivoting upward to an assembly/disassembly position and then downward to a working position.

12. The horizontal formwork system according to claim 11, wherein first guide support is fixed to a first coupling that is pivotally coupled to the fixed support.

13. The horizontal formwork system according to claim 12, wherein the first coupling includes a stop that abuts against the first support when the first guide support is in the working position.

14. A horizontal formwork system comprising:

a first module that includes first and second longitudinal beams that are arranged spaced-apart and parallel to one another, the first module further including first and second formwork panels that are each supported on the first and second longitudinal beams, the second form work panel being located forward of the first formwork panel;

a second module that includes a third longitudinal beam parallel to and located forward of the first longitudinal beam and a fourth longitudinal beam parallel to and located forward of the second longitudinal beam;

a first head that supports a forward end of the first longitudinal beam and a rear end of the third longitudinal beam;

a second head that supports a forward end of the second longitudinal beam and a rear end of the fourth longitudinal beam;

a safety structure that is arranged below the second formwork panel and at least partially covers a gap existing forward of the second formwork panel, the safety structure including a protection platform that is attached to first and second longitudinal supports that are arranged spaced-apart and parallel to one another, the first and second longitudinal supports being arranged parallel to the first and second longitudinal beams, the protection platform being configured to capture an operator of the horizontal formwork system in the event the operator falls during an installation of the second formwork panel;

a displacement assembly that facilitates a movement of the safety structure in a forward movement direction, the displacement assembly configured to be operated on by the operator to move the safety structure in the forward movement direction across the first and second heads without the need to disassemble the safety structure, wherein each of the first, second, third and fourth longitudinal beams has coupled thereto a guide support, the safety structure including first and second guide elements that are respectively coupled to the first and second longitudinal supports of the safety structure, the first guide element resting on the guide support of the first or third longitudinal beam, the second guide element resting on the guide support of the second or fourth longitudinal beam, the guide support associated with the first or third longitudinal beam including a first structure that limits a horizontal and transverse displacement of the first longitudinal support inside said guide support and a second structure that limits vertical displacement of the first longitudinal support inside said guide support.

15. The horizontal formwork system according to claim 14, wherein the guide support associated with the second or fourth longitudinal beam includes a first structure that limits a horizontal and transverse displacement of the second longitudinal support inside said guide support and a second structure that limits vertical displacement of the second longitudinal inside said guide support.

16. A horizontal formwork system comprising:

a first module that includes first and second longitudinal beams that are arranged spaced-apart and parallel to one another, the first module further including first and second formwork panels that are each supported on the first and second longitudinal beams, the second form work panel being located forward of the first formwork panel;

a second module that includes a third longitudinal beam parallel to and located forward of the first longitudinal beam and a fourth longitudinal beam parallel to and located forward of the second longitudinal beam;

a first head that supports a forward end of the first longitudinal beam and a rear end of the third longitudinal beam;

a second head that supports a forward end of the second longitudinal beam and a rear end of the fourth longitudinal beam;

a safety structure that is arranged below the second formwork panel and at least partially covers a gap existing forward of the second formwork panel, the safety structure including a protection platform that is attached to first and second longitudinal supports that are arranged spaced-apart and parallel to one another, the first and second longitudinal supports being arranged parallel to the first and second longitudinal beams, the protection platform being configured to capture an operator of the horizontal formwork system in the event the operator falls during an installation of the second formwork panel;

a displacement assembly that facilitates a movement of the safety structure in a forward movement direction, the displacement assembly configured to be operated on by the operator to move the safety structure in the forward movement direction across the first and second heads without the need to disassemble the safety structure, wherein the displacement assembly comprises first, second, third and fourth guide supports that are respectively coupled to the first, second, third and fourth longitudinal beams, and first and second guide elements that are respectively coupled to the first and second longitudinal supports of the safety structure, the first guide element configured to slide on the first and third guide supports, the second guide element configured to slide on the second and fourth guide supports, the horizontal formwork system further comprising a first blocking apparatus associated with the first guide element that is configured to block a forward longitudinal movement of the safety structure through a first gap that separates the first and second longitudinal beams, the blocking apparatus residing in the first gap and abutting the second guide support.

17. The horizontal formwork system according to claim 16, comprising a second blocking apparatus associated with the second guide element that is configured to block a forward longitudinal movement of the safety structure through a second gap that separates the third and fourth longitudinal beams, the blocking apparatus residing in the second gap and abutting the fourth guide support.

18. The horizontal formwork system according to claim 16, wherein the first blocking apparatus includes a part pivotally coupled to the safety structure, the part configured to pivot from a working position to a blocking position, in the working position the part is in contact with the first guide support, in the blocking position the part abuts against the second guide support arranged forward of the gap preventing forward movement of the safety structure.

19. The horizontal formwork system according to claim 18, wherein the part includes a releasing element which, when actuated by the operator, forces the part to pivot upward until it no longer abuts against the second guide support to allow the forward movement of the safety structure onto the second guide support.

20. A method for installing a horizontal formwork system comprising:

attaching a first end portion of a first formwork panel to a first longitudinal beam and attaching a second end portion of the first formwork panel to a second longitudinal beam that is arranged spaced-apart and parallel to the first longitudinal beam;

attaching to the first beam a first guide support and attaching to the second beam a second guide support;

prior to installing a second formwork panel forward of the first formwork panel longitudinally advancing a safety structure located below the first formwork panel so that the safety structure at least partially covers a gap existing forward of the first formwork panel, the safety structure including a protection platform that is attached to first and second longitudinal supports that are arranged spaced-apart and parallel to one another, the first and second longitudinal supports being arranged parallel to the first and second longitudinal beams, the protection platform being configured to capture an operator of the horizontal formwork system in the event the operator falls during an installation of the second formwork panel;

the longitudinally advancing of the safety structure comprising placing the first longitudinal support or a guide element attached to the first longitudinal support into sliding engagement with the first guide support and placing the second longitudinal support or a guide element attached to the first longitudinal support into sliding engagement with the second guide support and sliding the safety structure in the forward movement direction.

* * * * *